United States Patent [19]

Dahlman

[11] Patent Number: 4,811,669

[45] Date of Patent: Mar. 14, 1989

[54] PORTABLE DRIVE MEANS SUPPORTED ON A SKIER

[75] Inventor: Sten Dahlman, Stockholm, Sweden

[73] Assignee: Industrimekanik I Stockholm AB, Stockholm, Sweden

[21] Appl. No.: 846,343

[22] Filed: Mar. 31, 1986

[30] Foreign Application Priority Data

Apr. 11, 1985 [SE] Sweden ..... 8501783

[51] Int. Cl.[4] ..... B61B 7/06

[52] U.S. Cl. ..... 105/30; 104/112; 104/287; 105/141; 105/149.1

[58] Field of Search ..... 104/173 ST, 234, 235, 104/173.2, 229–231, 112, 118, 287; 105/30, 26.05, 134, 141, 142, 149.1, 151

[56] References Cited

U.S. PATENT DOCUMENTS

| | | | |
|---|---|---|---|
| 553,233 | 1/1896 | Evans | 104/234 |
| 3,012,520 | 12/1961 | Curtis | 104/235 |
| 3,354,835 | 11/1967 | Pannick et al. | 104/235 X |
| 3,405,651 | 10/1968 | Harmon | 104/173.2 |
| 3,473,486 | 10/1969 | Harmon | 104/173.2 |
| 3,498,236 | 3/1970 | Meek | 105/30 |
| 4,492,168 | 1/1985 | Cellai | 105/30 |

FOREIGN PATENT DOCUMENTS

| | | | |
|---|---|---|---|
| 484160 | 4/1928 | Fed. Rep. of Germany | 104/235 |
| 1155822 | 5/1958 | France . | |
| 1279934 | 11/1961 | France . | |
| 1412901 | 8/1965 | France | 104/173 ST |
| 1532365 | 6/1968 | France . | |
| 2335381 | 7/1977 | France . | |
| 2434111 | 3/1980 | France . | |
| 335232 | 2/1936 | Italy | 104/173 ST |
| 355472 | 8/1961 | Switzerland . | |
| 6988 | of 1898 | United Kingdom | 104/235 |

*Primary Examiner*—Robert B. Reeves
*Assistant Examiner*—Scott H. Werny
*Attorney, Agent, or Firm*—Young & Thompson

[57] ABSTRACT

A portable drive for coaction with a band is provided with a motor driven drive roller for transporting the drive along the band. The drive roller with coacting structure for maintaining operative coaction with the band are settable to two main positions, viz, an operative and a neutral position, the band in the neutral position running freely while the drive roller with coacting structure being cantilevered so that the band can be freely taken aside for disengagement of the band from the drive, or for inserting the band from the side over the drive roller to coact therewith after resetting to the operative position. The inventive drive is primarily intended to be attachable to a skier allowing him to be towed up a hill along a band which is anchored at its upper end to a tree, for example.

5 Claims, 3 Drawing Sheets

PORTABLE DRIVE MEANS SUPPORTED ON A SKIER

Figure 1:
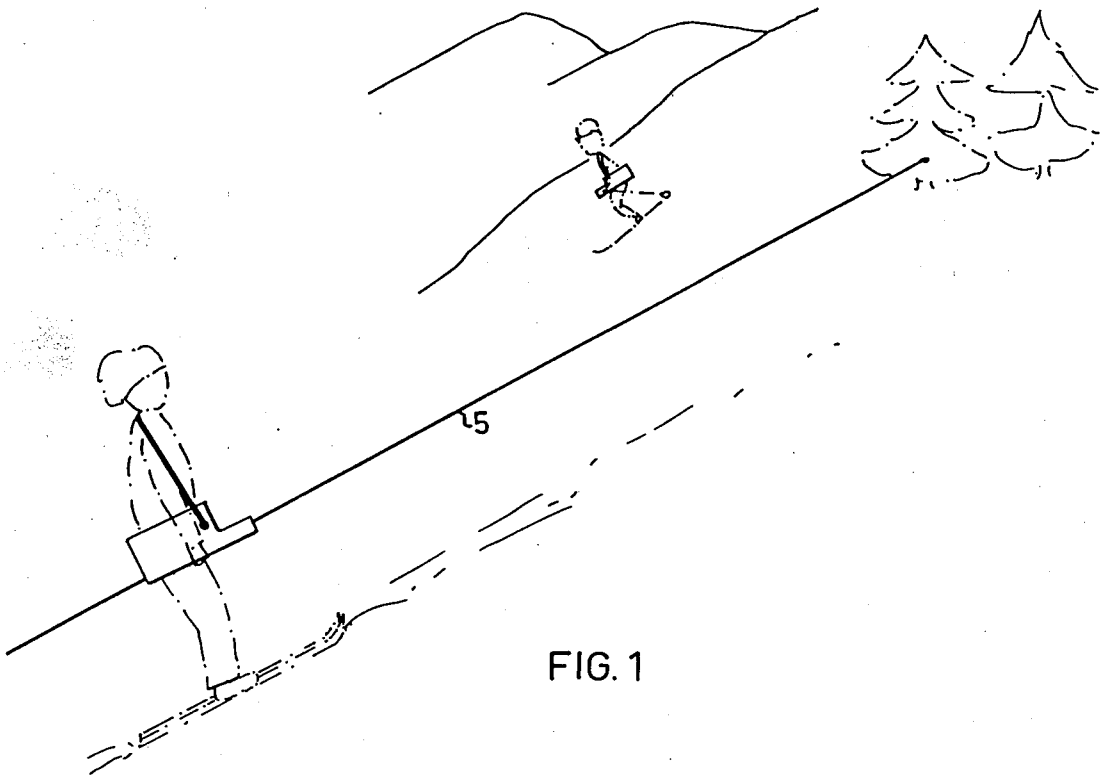

The present invention relates to a personal ski lift.

Drive means intended for moving a load between two horizontally or vertically spaced points have been well-known for a long time. The most common constructive solution would be to drive an endless rope onto which the load is hooked in one way or the other. The drive means is then stationary.

Another solution is the utilization of an immobile rope and a mobile drive means "climbing" on the rope.

The latter principle, fixed line-mobile drive means, is known for example from the French Pat. No. 1,155,822 describing a type of snowmobile which is driven along a rope stretched between its starting and end points.

The U.S. Pat. No. 3,307,494 teaches a drive means which winds up the wire during transport.

The U.S. Pat. No. 3,473,486 relates to a drive means climbing on a rope affixed under tension at both ends and which is in principle a drive means used for a so-called cable ferry.

The Swiss Pat. No. 518,827 relates to a drive means which winds up the rope during the working cycle.

The prior art technique also includes, for example, the U.S. Pat. Nos. 3,739,728, 3,368,498 and 3,001,483, the Swiss Pat. Nos. 632,962, 198,602 and the French Pat. No. 2,097,254.

It could be said in conclusion that the drive means according to the aforesaid patent specifications possess one or more of the following properties.

(1) They are immobile in the sense that they cannot be moved or transported by an individual.

(2) They are "locked" to their rope, that is in order to release the drive means from the rope, the drive means must be wound off from the rope at either one of the end points of the rope. This procedure involves a mounting and dismounting process which cannot be carried out regularly and during normal operation.

(3) They present difficulties in practical use for allowing the accommodation of several drive means on one and the same rope, for example with regard to the return transport.

(4) Changing from one rope to another using one and the same drive means is an elaborate procedure.

(5) Problems arise in connection with the return transport. Conventional solutions either lead to an uncontrollable return transport, or to complications and/or higher costs in the form of speed control means, for example.

The object of the present invention is to achieve a drive means which can be readily engaged with or disengaged from any point between the rope ends thereby enabling the drive means to be completely loosened from the rope. The term rope used in the present context also signifies a band, a wire, a chain or the like.

The invention is primarily intended for use as a simple ski lift. For this purpose, the drive means according to the invention is carried by a support means such as a T-bar or brace to be placed behind the back or the thighs of the skier, enabling in this manner the drive means to move with the skier along the band. The upper end of the band is thereby secured to a tree, for example, at the top of the hill. The skier will thus be towed uphill along the band in a simple manner. The brace can be articulatedly made with an additional backing member which can be folded out to a support position for transporting a second skier as well, that is two skiers can be transported with the aid of one single drive means.

In the ski area there may be hills with various degrees of slope, different locations and different orientations, and for such reasons several bands may have to be load out to form different band systems. Since the drive means is affixed to the body of the skier, the skier can leave a band at any time, change to another band, or ski downhill and then connect to another band at any arbitrary point along the length thereof.

A drive means according to the invention is schematically illustrated on the attached drawings.

FIG. 1 shows a skier provided with a drive means according to the invention on his way downhill, and another skier provided with a drive means according to the invention during uphill transport along a band anchored to a tree at its upper end.

Figure 2:
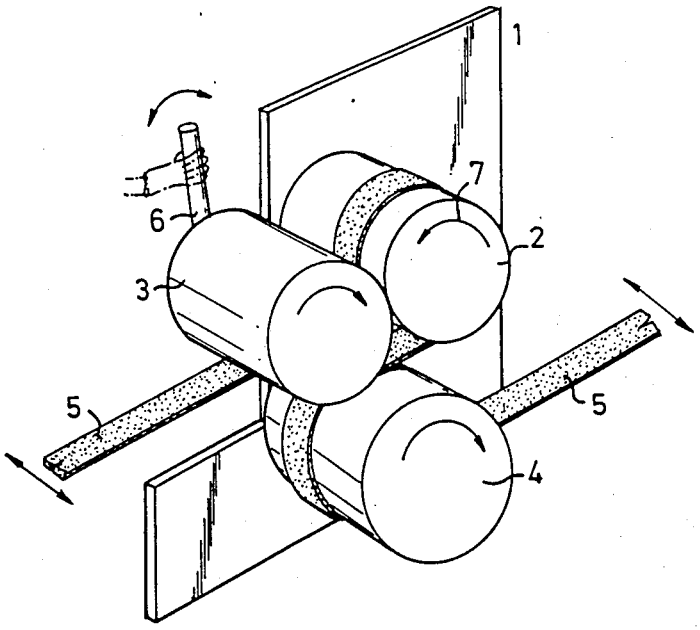
Figure 3:
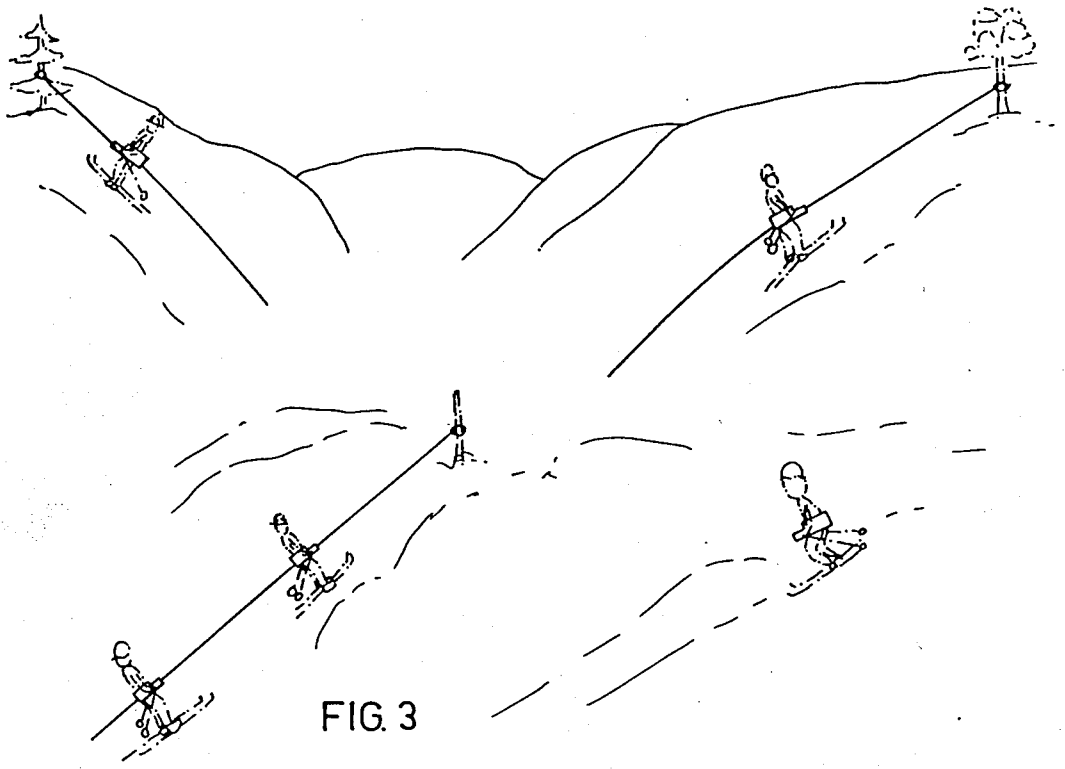

FIG. 2 shows schematically a simplified embodiment of the inventive drive means, and FIG. 3 illustrates the formation of a band system for various slopes made up of a number of individual bands, a skier provided with a drive means according to the invention thereby being able to utilize a first, lower band for transport up to a point where he can decide to continue a further distance upwards along the one or the other of the two upper bands shown.

The drive means shown in FIG. 2 consists of a frame 1 carrying a rotatably journalled, motor driven drive roller 2 and coacting means such as a tension roller 3 and a guide roller 4. A band 5 runs in under the guide roller 4, around it, round the drive roller 2 and in between the drive roller and the tension roller 3. By means of a lever 6, the spring loaded tension roller 3 can be moved between a driving position where the band is clamped between the tension roller 3 and the drive roller 2 for feeding the drive means along the band, and a neutral position where the band is allowed to run freely between the rollers.

FIG. 2 illustrates the tension roller 3 in a neutral position. In this position, all rollers are cantilevered for the band to be easily taken out to the sides from the rollers, or be brought in from the side between the rollers.

The drive roller 2 is operated by a drive motor 2*a* supported by the frame 1.

When the lever 6 is turned to the operative position and the drive roller is driven in the direction indicated by the arrow 7, the drive means will be displaced along the band in the direction indicated by the arrow 8. The band portion fed out from the guide roller is then secured at its end to a tree for example, as is shown in FIG. 1.

In order to eliminate the risk of ski lift accidents in the case of band breakdown, there is suitably arranged at the upper end of the band a weak point with regard to tensile strength. Immediately below this breaking point there is affixed a parachute to the band, so that in case of overload and rupture at the breaking point, the band will be pulled down by the skier. This movement is then retarded by the parachute.

I claim:

1. A personal ski lift comprising a frame, means to support the frame on the body of a skier, a motor-driven drive roller carried by the frame and contacting a stationary flexible elongated member disposed along the desired path of travel of the skier along a slope to be ascended, a tension roller contacting said flexible member adjacent said drive roller, said flexible member removably engaging each of said drive and tension rollers to permit removal of said ski lift from contact with said flexible member, means mounted on the frame and operable by said skier for selectively establishing and releasing driving connection between said flexible member and the drive roller by movement of one of said drive and tension rollers toward or away from each other, whereby when said driving connection is established between said flexible member and said drive roller, said skier is towed along said flexible member.

2. A personal ski lift as claimed in claim 1, further including guide means which cooperates with said tension roller to cause said flexible member to contact substantially the entire circumference of said drive roller.

3. A personal ski lift as claimed in claim 2, wherein said guide means comprises a guide roller positioned adjacent said drive roller.

4. A personal ski lift as claimed in claim 3, wherein said means mounted on the frame and operable by said skier for selectively establishing and releasing driving connection between said flexible member and the drive roller by movement of one of said drive and tension rollers toward or away from each other comprises lever means which coacts with a spring-biased tension roller to cause said tension roller to clamp said flexible member between said tension roller and said drive roller.

5. A personal ski lift as claimed in claim 3, wherein each said rollers are cantilevered from said support and have parallel axes which permits said flexible member to be withdrawn from engagement with said rollers.

* * * * *